US005370319A

United States Patent [19]

Schlegel

[11] Patent Number: 5,370,319

[45] Date of Patent: Dec. 6, 1994

[54] SLOT NOZZLE FOR EDGE BANDING

[75] Inventor: Willi Schlegel, Neuss, Germany

[73] Assignee: Nordson Corporation, Westlake, Ohio

[21] Appl. No.: 911,968

[22] Filed: Jul. 10, 1992

[30] Foreign Application Priority Data

Jul. 11, 1991 [DE] Germany ..... 9108543[U]

[51] Int. Cl.[5] ..... B05B 1/30

[52] U.S. Cl. ..... 239/582.1; 239/562; 239/581.1; 239/597; 222/554; 251/209; 251/1

[58] Field of Search ..... 239/581.1, 581.2, 582.1, 239/569, 597, 562, 568; 251/208, 209, 340; 222/554

[56] References Cited

U.S. PATENT DOCUMENTS

| | | | |
|---|---|---|---|
| 464,550 | 12/1891 | Bowman | 239/562 |
| 1,304,384 | 5/1919 | Schlatter | 239/582.1 |
| 2,558,238 | 6/1951 | Collins | 239/461 |
| 3,314,163 | 4/1967 | Kohler . | |
| 3,332,580 | 7/1967 | Spencer et al. . | |
| 3,642,181 | 2/1972 | Thomas et al. | 222/517 |
| 4,466,574 | 8/1984 | Dobson et al. | 239/445 |
| 4,667,879 | 5/1987 | Muller | 239/597 |
| 5,056,687 | 10/1991 | Claassen | 239/597 |
| 5,104,011 | 4/1992 | Clarke-Pounder et al. | 251/208 |

FOREIGN PATENT DOCUMENTS

| | | | |
|---|---|---|---|
| 2233322 | 7/1972 | Germany . | |
| 3331739A1 | 3/1985 | Germany . | |
| 3234964C2 | 10/1987 | Germany . | |
| 3248889C1 | 2/1988 | Germany . | |
| 9206304.7 | 9/1992 | Germany . | |
| 0054864 | 3/1984 | Japan | 251/208 |

*Primary Examiner*—Andres Kashnikow
*Assistant Examiner*—Christopher G. Trainor
*Attorney, Agent, or Firm*—Wood, Herron & Evans

[57] ABSTRACT

An adjustable slot nozzle is provided including a nozzle body having a surface formed with an elongated slot, at least one supply channel connected to a source of fluid, a number of second channels having an inlet and an outlet connected to the elongated slot and a cylindrical slider member positioned between the supply channel and the inlets to the second channels to control the flow of fluid therebetween. The slot nozzle also includes a sleeve construction which varies the axial width of the elongated slot through which fluid can be discharged.

23 Claims, 4 Drawing Sheets

SLOT NOZZLE FOR EDGE BANDING

FIELD OF THE INVENTION

The invention is concerned with a wide nozzle in the form of a slot for applying fluids, in particular fusion adhesives, having a nozzle body through which runs a supply line for fluids which consists of at least one first channel, the nozzle body exhibiting a plurality of smaller second channels which end at its surface and serve for the delivery of the fluid to be applied from the wide slot-nozzle and the openings from which on the delivery side are arranged in a way extending along the axial length.

BACKGROUND OF THE INVENTION slot nozzles are employed, e.g., in hot glue guns, by which fusion adhesive fed to them in solid form is melted and applied uniformly to an area which is to be coated, e.g., an edge strip. One slot nozzle of this type is shown in DE-GM 89 07 752.0. In the case of this nozzle an outlet region formed in the shape of a slot is arranged at right angles to the direction of application so that the fluid may be applied in the form of a stripe the width of which corresponds with the length of the slot. Certainly these so-called wide slot-nozzles may readily be used for numerous applications such as, e.g., the coating of edge strips in continuous operation because here the fluctuation in thickness of the applied layer which arises upon interruption of the feed of adhesive, plays no part because of the continuous operation. But there are also cases in which in operation with interruptions in the feed of adhesive the main thing is that the thickness of application of the adhesive shall remain as constant as possible over the whole area to be coated. Such a case arises, e.g., in gluing the backs of books, because the present wide slot-nozzles are less suited to this application. That is, in gluing the backs of a number of books in succession with the necessity of interruption in the application between every two books, problems arise in particular through adhesive keeping on oozing out (intermittent operation).

SUMMARY OF THE INVENTION

Consequently the problem underlying the invention is to develop further a nozzle of the kind named initially for the application of fluids, in such a way that the constancy of the thickness of application is considerably improved as compared with the state of the art, even in the case of intermittent operation.

The solution of this problem is effected for a nozzle in accordance with the preamble to the main claim by a shutoff member at the transition from the supply line to the second channels, by which the admission of fluid into the second channels may be shut off.

Hence in applying the nozzle in accordance with the invention the flow of the fusion adhesive may be interrupted definitely and without its keeping on running or dripping out when the end of a zone which is to be coated (e.g., the back of a book) is reached. Consequently greater thicknesses of the layer of adhesive in this zone are avoided, such as may occur in particular because of its keeping on running out of the nozzle if the feed is already interrupted outside the nozzle.

The shutoff member is preferably made in the form of a rotary slider which is supported in a bore and is pierced by third channels which run through the rotary slider essentially perpendicularly to its axis and by which the second channels may be prolonged, the rotary slider exhibiting a flat running axially from which—in the direction of flow of the fluid—the third channels start, and forming by the flat and the adjacent wall of the bore a distributor chamber in which the fluid arrives from the supply line.

The axis of the rotary slider supported in the bore preferably runs in parallel with and at a distance from the axis of the nozzle body.

In that case the second channels may run radially to the nozzle body and the third channels radially to the rotary slider.

Further, the rotary slider may be supported in the bore in such a way that for interruption of the feed it is able to shift axially.

The actuation of the rotary slider may be effected, e.g., pneumatically.

In the case of a preferred embodiment the supply line is formed of one channel portion running axially, which exhibits at one endface of the nozzle body a connector for an external supply of fluid, as well as of channel portions running radially, which branch off from the axial channel portion and open into the bore.

The nozzle body may moreover exhibit bores for individual elements, for sensors, as well as a corresponding connector chamber from which these bores start.

For coating areas of different widths it is further advantageous if the delivery zone may be adapted to this width. For doing that sleeves are provided which are arranged to be able to shift axially along the nozzle body and serve for lateral limitation of the delivery zone lying between them. The endfaces of the sleeves facing one another may again be shaped for guiding an object which is to be coated. In that case it is useful if there are fixing elements for locking the sleeves on the nozzle body.

In the case of special kinds of application, e.g., the coating of edge strips, it is necessary to keep the edge zone of the coated area free. For this purpose a plate having a projection at the side at the bottom may be fitted to each sleeve. The outlet zone is then formed by a slot in the surface of the nozzle body, into which the second channels open and in which the projection at the side at the bottom lies flush with the surface of the nozzle body.

DESCRIPTION OF THE DRAWINGS

Further details, features and advantages of the invention follow from the description below of an embodiment with the aid of the drawings. There is shown in.

DETAILED DESCRIPTION OF THE INVENTION

Figure 1:
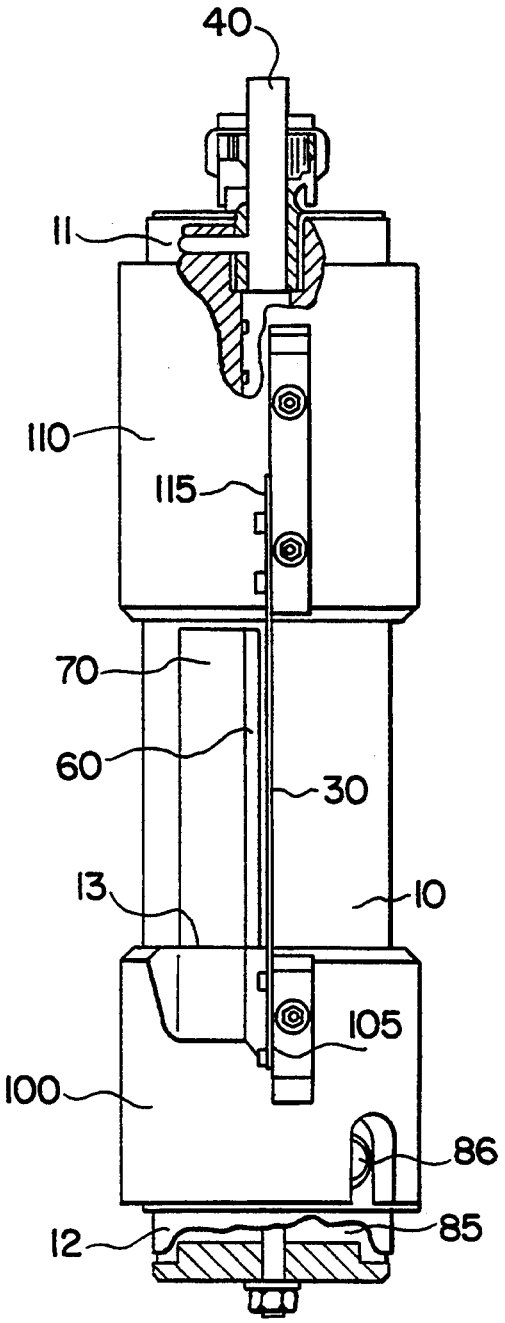
FIG. 1 is a front elevation of the nozzle in accordance with the invention, partially sectioned.

In FIG. 1 a nozzle is shown, which is formed of a nozzle body 10 with clamping areas 11, 12 lying at the axial ends and with a slot 30 (fluid delivery zone), a tear-off edge 60 and a recessed portion 70 of surface as well as a first sleeve 100 and a second sleeve 110. The plates 105, 115 may be fitted as shown to the first and second sleeves respectively if an edge zone of a coated surface is to be kept free of adhesive as is frequently desirable in the case of edge strips. The plates then exhibit in each case a projection to the side at the bottom (not shown) which, starting from the inner endface of one sleeve, lies in the slot 30 and extends there in the direction of the other sleeve to correspond with the width of the zone to be kept free of adhesive, and terminates flush with the surface of the nozzle body. Further, the end portion of a rotary slider 40 is shown. The first and second sleeves may be pushed axially by hand onto the nozzle body, whereby the width of the delivery zone may be adapted to the width of the area to be coated. Further, the sides of the sleeves facing one another are so shaped that they are suited to the guidance of, e.g., the back of a book or of an edge strip.

In one embodiment which is not shown, for the coating of edge strips one manages with one of the plates 105, 115. This is achieved, for example, by positioning the lower sleeve 100 in the built-in state on the nozzle body 10 in such a way that between the axially bottom end of the slot 30 and the radial end plane of the sleeve 100, indicated by the reference number 13, a certain distance results which is equal to that width of the edge of the edge strip, which is to be kept free of adhesive. The other sleeve of the embodiment is adjustable in the axial direction with respect to the nozzle body 10 by a lead screw.

Figure 2:
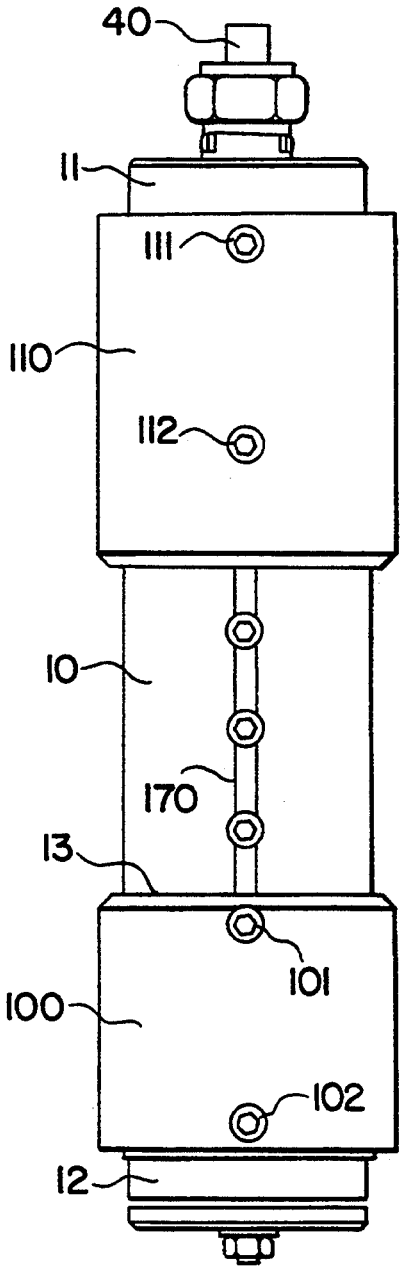
FIG. 2 is a view from the rear of the nozzle shown in FIG. 1.

In the rear view of the nozzle shown in FIG. 2 a slot 170 is shown. Furthermore fixing screws 101, 102; 111, 112 may be seen on the sleeves, which with the slot 170 serve to secure the sleeves axially and against twisting.

Figure 4:
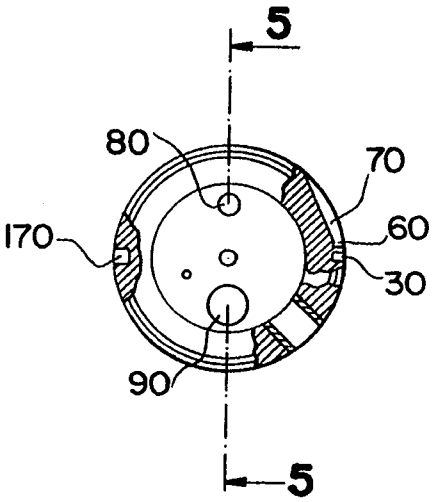
FIG. 4 is a partially sectioned view from the left of the nozzle body shown in FIG. 3.
Figure 3:
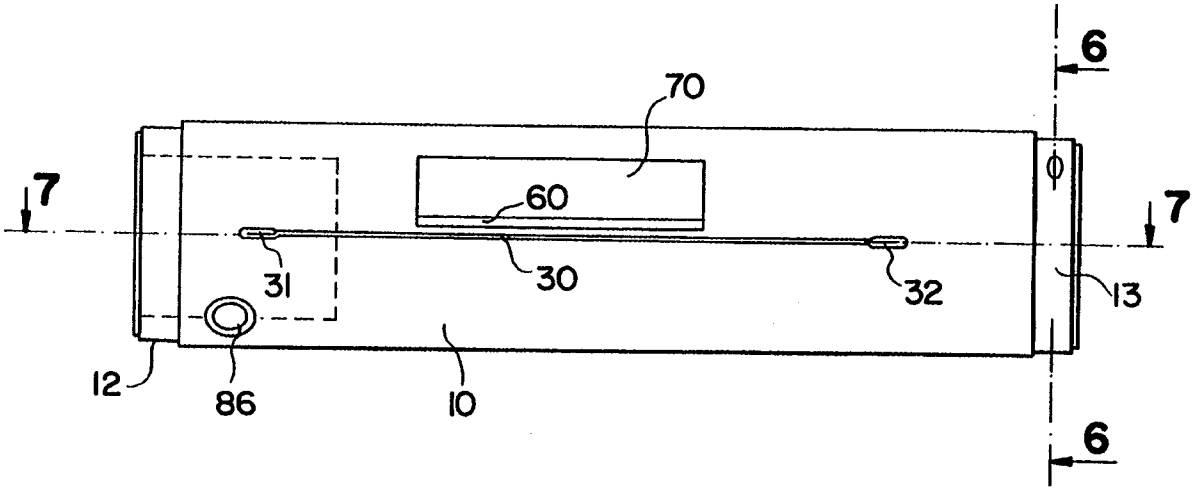
FIG. 3 is a view of the nozzle body.

FIG. 3 shows a detailed elevation of the nozzle body 10. The delivery zone is made in the form of a slot 30 extending along the nozzle body and is widened in its end portions 31, 32. Further, along the middle region of it the tear-off edge 60 is provided, running in parallel at a certain distance away, which defines the depressed portion 70 of surface, which in turn runs out at the side remote from the outlet zone. This zone may also be recognized in the cross-section shown in FIG. 4. Bores 80 for a temperature sensor or 90 for a heater element are moreover shown there.

Figure 6:
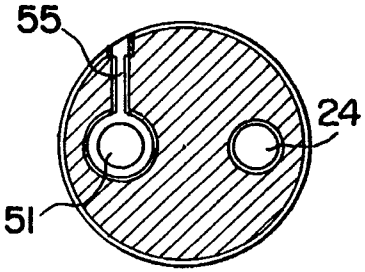
FIG. 6 is a cross-section along the line D—D in FIG. 3.
Figure 5:
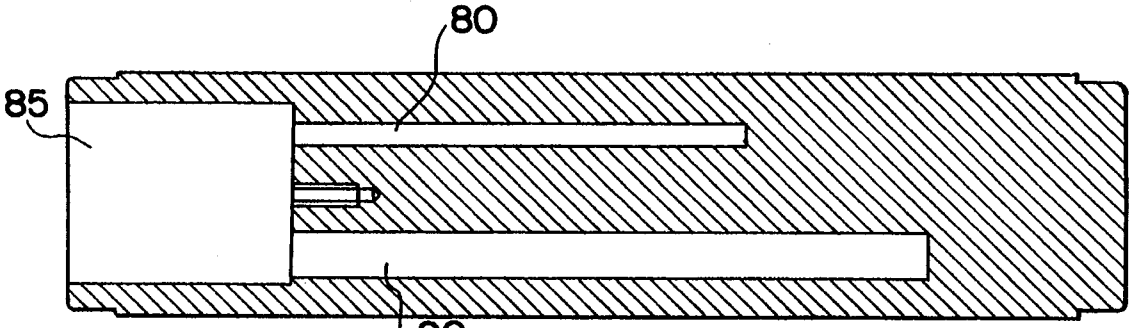
FIG. 5 is a longitudinal section along the line A—A in FIG. 4.
Figure 7:
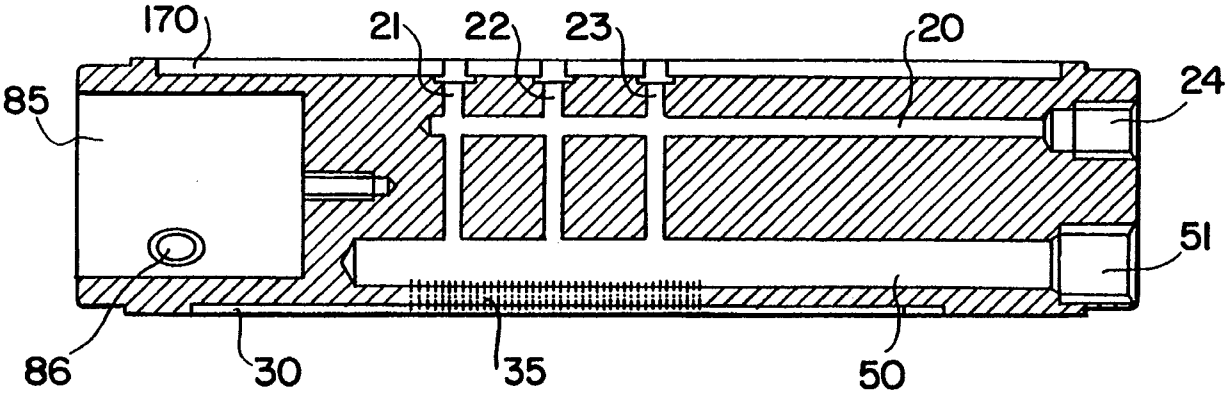
FIG. 7 is a longitudinal section along the line B—B in FIG. 3.

In the longitudinal section shown in FIG. 5 the arrangement and course of the bores 80 and 90 for the sensor and heating element respectively and of a cable terminal chamber 85 with a hole 86 for the cable leading out are represented. FIG. 6 on the other hand shows in cross-section an inlet opening 24 to a first channel 20 for the fusion adhesive as well as a tapped hole 51 at the start of a bore 50 which serves to receive the rotary slider 40. The bore 50 further exhibits a perpendicular tapped hole 55 for receiving a screw by which a screw inserted in the tapped hole 51 is secured against turning. In FIG. 7 (cross-section along the line B—B in FIG. 3) the course is shown of the first channels 20, 21, 22, 23 and of the bore 50 which communicates with the slot 30 via second channels 35. The channels 21, 22, 23 which branch off the channel 20 and open into the bore 50, create in this way a connection communicating between the channel 20 and the delivery zone. The channels 21, 22 and 23 run moreover after the style of branch channels, starting from the rear slot 170 through the channel 20 into the bore 50. A plurality of smaller second channels 35 are shown, starting from the bore 50 (on the width of the tear-off edge 60), which end in the slot 30.

Via the opening 24 which may be made, e.g., as a screw connection, the fusion adhesive to be applied is fed to the channel 20 and while being held at the necessary temperature by the heater elements lying in the bore 90, arrives through the channels 21, 22 and 23 in the bore 50. In this bore there is the rotary slider 40 represented in FIGS. 8–10, which by means of a screw is held to be able to turn but unable to shift axially in the bore 50.

Figure 8:
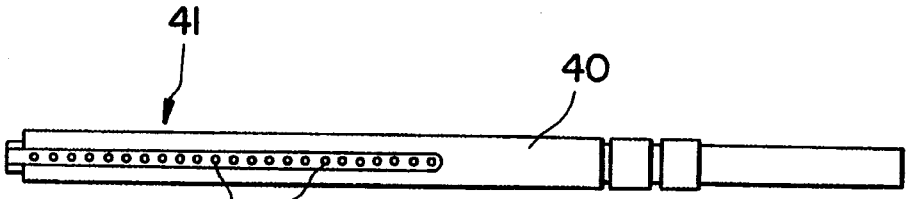
FIG. 8 is an elevation of a rotary slider.

In accordance with the plan view shown in FIG. 8 the rotary slider exhibits in its lefthand region 41 a plurality of small third channels 45 the diameter of which corresponds roughly with the diameter of the second channels 35 leaving the bore 50, and which run essentially perpendicular to the axis of the rotary slider through the latter. The length of the portion of the rotary slider which exhibits the openings to these third channels 45, corresponds with about the length of the zone of the bore 50 from which the second channels 35 start. Both zones are finally arranged axially in such a way that the third channels 45 prolong the second channels 35 in the direction of the first channels 20, 21, 22, 23. Turning of the rotary slider is effected at that end of it which projects from the bore 50, by means of devices which are not shown.

Figure 9:
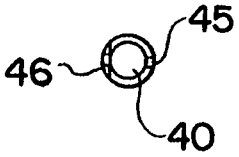
FIG. 9 is an end view from the left of the rotary slider shown in FIG. 9.
Figure 10:
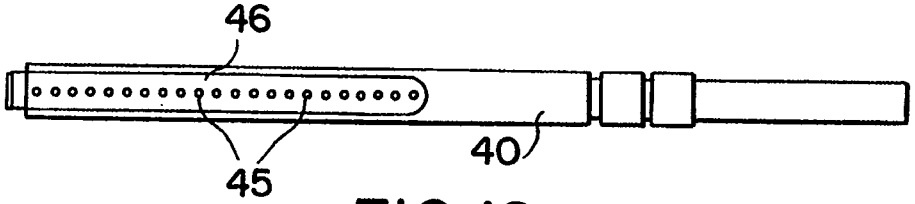
FIG. 10 is a rear view of the rotary slider shown in FIG. 9.

FIG. 9 shows an end view from the left of the rotary slider in accordance with FIG. 8. The third channels 45 running through the rotary slider perpendicularly to its axis start—in the direction of flow of the fluid—in a flat 46 which may also be seen in the rear view represented in FIG. 10.

The adhesive fed through the first channels 20, 21, 22 and 23 arrives in the bore 50 and is distributed along a distributor space which is defined by the flat 46 and the adjoining wall of the bore 50.

From there the adhesive arrives in the third channels 45 in the rotary slider 40. In the operational state of the nozzle the rotary slider is so aligned that the adhesive can arrive in the second channels 35 in order to be applied from there via the slot 30 to the area which is to be coated.

For interruption or termination of the delivery of adhesive from the nozzle the rotary slider is twisted through an angle dependent upon the area of cross-section of the second and third channels until the openings no longer coincide. Now no adhesive can any longer keep flowing from the bore 50 or the channels 20 to 23. The adhesive remaining in the second channels 35 as well as in the slot 30 remains clinging there, so that in particular at the end of an area which is to be coated the thickness of adhesive is not greater than over the remaining areas.

What is claimed is:

1. A nozzle for applying fluids, comprising:

a nozzle body having a discharge surface formed with an elongated slot extending axially therealong;

said nozzle body being formed with an adhesive supply passageway adapted to connect to a source of fluid;

said nozzle body being formed with a number of channels each having an inlet and an outlet connected to said elongated slot;

shut-off means, located between said adhesive supply passageway and said inlets to said channels, for controlling the flow of fluid into said channels.

2. The nozzle of claim 1 in which said nozzle body is formed with a bore, said shut-off means comprising a cylindrical slider member rotatably carried within said bore.

3. The nozzle of claim 2 in which said slider member is formed with a number of axially spaced second channels which extend substantially perpendicular to the longitudinal axis thereof, said second channels connecting said first channels to said adhesive supply passageway.

4. The nozzle of claim 2 in which said slider member has an exterior surface formed with an axially extending flat which forms a distribution chamber with the facing wall of said bore in said nozzle body which carries said slider member, said second channels beginning at said flat.

5. The nozzle of claim 2 in which said nozzle body has a longitudinal axis, said slider being carried within said bore so that said longitudinal axis of said slider is parallel to said longitudinal axis of said nozzle body.

6. The nozzle of claim 2 in which said slider member is axially fixed within said bore.

7. The nozzle of claim 2 in which said slider member is axially movable within said bore.

8. The nozzle of claim 1 in which said supply passageway includes an axially extending passage adapted to connect to the source of fluid, and a number of radially extending passageways connected between said axially extending passageway and said shut-off means.

9. A nozzle for applying fluids, comprising:

a nozzle body having a discharge surface formed with an elongated slot extending axially therealong;

said nozzle body being formed with an adhesive supply passageway adapted to connect to a source of fluid;

said nozzle body being formed with a number of channels each having an inlet and an outlet connected to said elongated slot;

at least one sleeve mounted to said nozzle body and axially slidable along said discharge surface thereof with respect to said elongated slot to vary the axial length of said elongated slot through which fluid can be discharged.

10. The nozzle of claim 9 including means for locking said at least one sleeve in a fixed position on said nozzle body.

11. The nozzle of claim 9 in which said at least one sleeve comprises a first sleeve and said nozzle further including a second sleeve, the sleeves being movable axially toward and away from one another along said nozzle body.

12. The nozzle of claim 11 in which said first and second sleeves are each formed with an end portion which face one another, said end portions being shaped to guide an object to receive fluid relative to said nozzle body.

13. The nozzle of claim 9 in which said at least one sleeve carries a plate having a projection insertable within at least a portion of said elongated slot at said discharge surface of said nozzle body, said projection terminating flush with said nozzle body and blocking the flow of fluid from at least a portion of the width of said elongated slot.

14. A nozzle for applying fluids, comprising:

a nozzle body having a discharge surface formed with an elongated slot extending axially therealong;

said nozzle body being formed with an adhesive supply passageway adapted to connect to a source of fluid;

said nozzle body being formed with a number of channels each having an inlet and an outlet connected to said elongated slot;

shut-off means, located between said adhesive supply passageway and said inlets to said channels, for controlling the flow of fluid into said channels;

at least one sleeve mounted to said nozzle body and axially slidable along said discharge surface thereof with respect to said elongated slot to vary the axial length of said elongated slot through which fluid can be discharged.

15. The nozzle of claim 14 in which said nozzle body is formed with a bore, said shut-off means comprising a cylindrical slider member rotatably carried within said bore.

16. The nozzle of claim 15 in which said slider member is formed with a number of axially spaced second channels which extend substantially perpendicular to the longitudinal axis thereof, said second channels connecting said first channels to said adhesive supply passageway.

17. The nozzle of claim 15 in which said slider member has an exterior surface formed with an axially extending flat which forms a distribution chamber with the facing wall of said bore in said nozzle body which carries said slider member, said second channels beginning at said flat.

18. The nozzle of claim 15 in which said nozzle body has a longitudinal axis, said slider being carried within said bore so that said longitudinal axis of said slider is parallel to said longitudinal axis of said nozzle body.

19. The nozzle of claim 14 in which said supply passageway includes an axially extending passage adapted to connect to the source of fluid, and a number of radially extending passageways connected between said axially extending passageway and said shut-off means.

20. The nozzle of claim 14 including means for locking said at least one sleeve in a fixed position on said nozzle body.

21. The nozzle of claim 14 in which said at least one sleeve comprises a first sleeve and a second sleeve movable axially toward and away from one another along said nozzle body.

22. The nozzle of claim 21 in which said first and second sleeves are each formed with an end portion which face one another, said end portions being shaped to guide an object to receive fluid relative to said nozzle body.

23. The nozzle of claim 14 in which said at least one sleeve carries a plate having a projection insertable within at least a portion of said elongated slot at said discharge surface of said nozzle body, said projection terminating flush with said nozzle body and blocking the flow of fluid from at least a portion of the width of said elongated slot.

* * * * *